United States Patent [19]

Blizzard et al.

[11] Patent Number: 4,860,991

[45] Date of Patent: Aug. 29, 1989

[54] SAFETY VALVE

[75] Inventors: William A. Blizzard; Ronald E. Pringle, both of Houston, Tex.

[73] Assignee: Camco, Incorporated, Houston, Tex.

[21] Appl. No.: 334,035

[22] Filed: Apr. 6, 1989

[51] Int. Cl.[4] ..... E21B 43/12

[52] U.S. Cl. ..... 251/62; 166/319; 251/348

[58] Field of Search ..... 251/62, 348; 166/319, 166/324, 322, 332

[56] References Cited

U.S. PATENT DOCUMENTS 3,092,135 6/1963 Brown ..... 251/62 X 3,799,258 3/1974 Tausch ..... 251/62 X 4,161,219 7/1979 Pringle ..... 251/62 X 4,716,968 1/1988 Pringle ..... 168/319

*Primary Examiner*—Alan Cohan

*Attorney, Agent, or Firm*—Fulbright & Jaworski

[57] ABSTRACT

A safety valve where weight and length and consequently the cost is reduced to a minimum. A longitudinally moveable flow tube controls the movement of a valve closure element, a biasing mechanism biases the tube to a closed position, and a piston and cylinder assembly engages and moves the flow tube. A portion of the assembly is positioned beside and longitudinally overlaps the biasing mechanism for allowing the length of the valve to be reduced.

12 Claims, 4 Drawing Sheets

11
15
32
10
38
14
34
36
12
40
30
26
22
28
24
20
16
18
13
E
D
C
B
A 10a
14a
32a
12a
38a
34a
26a
36a
22a
16a
18a
40a 32b
10b
12b
14b
38b
34b
26b
36b
16b
22b
6
6
18b

SAFETY VALVE

BACKGROUND OF THE INVENTION

It is well known as disclosed by U.S. Pat. No. 4,161,219 to provide a safety valve in which a flow tube is moved by a hydraulic and piston assembly to control the movement of a valve closure element in which biasing means urges the flow tube in a direction to cause the valve closure element to move to a closed position. However, such safety valves, particularly when made with exotic materials, become quite expensive.

The present invention is directed to a safety valve, either subsurface or surface, in which the overall size, length and weight is kept to a minimum and which also reduces its cost. The present invention is directed to a safety valve having a unique geometry which allows its weight and length to be minimized by more efficiently utilizing the volume of space available within the valve housing. In addition, the present design provides a minimum of moving parts and seals and provides a reduction in flow tube binding problems, all of which produces a more desirable valve.

SUMMARY

The present invention is directed to a safety valve for controlling the fluid flow through a conduit including a housing having a bore therethrough with a valve seat in the bore. A valve closure element moves between open and closed position relative to the valve seat for controlling the fluid flow through the bore. A longitudinal flow tube is telescopically movable in the housing for controlling the movement of the valve closure element and biasing means are provided in the housing for urging the flow tube in a direction for causing the valve closure element to move to the closed position. A piston and cylinder assembly is positioned in the housing and includes a piston member movable relative to a cylinder member and one of the members engages and moves the flow tube. The one member is positioned beside and longitudinally overlaps the biasing member thereby allowing the length of the valve to be reduced.

Another object of the present invention is wherein the one member is positioned outside of the biasing member in one embodiment and inside of the biasing member in another embodiment.

A still further object of the present invention is wherein the one member extends through the valve seat when the valve is in the open position utilizing the valve closure element space thereby reducing the required number of moving parts and seals required.

Still a further object of the present invention is wherein the one member extends from one side of the valve seat to the second side of the valve seat when the valve moves to the open position.

Yet a still further object of the present invention is wherein the one member is positioned within the outer periphery of the flow tube which has the advantage of reducing the diameter of the valve and also reducing the flow tube binding problems by reducing the moment arm actuating the flow tube.

Still a further object is wherein the safety valve is a subsurface well safety valve for controlling the fluid flow through a well conduit in which the housing has a longitudinal bore with a valve seat therein. A longitudinal flow tube telescopically moves in the housing for controlling the movement of a valve closure member relative to the valve seat, biasing means biases the flow tube to move the valve to a closed position, and a piston and cylinder assembly includes a piston member and a cylinder member. One of the members is connected to and moves the flow tube. The one member longitudinally overlaps and is positioned on the inside of the biasing member. The one member also longitudinally extends and overlaps the valve closure member when the valve moves to the open position.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

While the present improvement in a safety valve will be shown, for purposes of illustration only, as incorporated in a flapper-type tubing retrievable safety valve having rod pistons, it will be understood that the present invention may be used with other types of safety valves, both subsurface and surface, wireline and pump down safety valves, and safety valves having various types of valve closing elements, such as ball valve closure elements.

Figure 1:
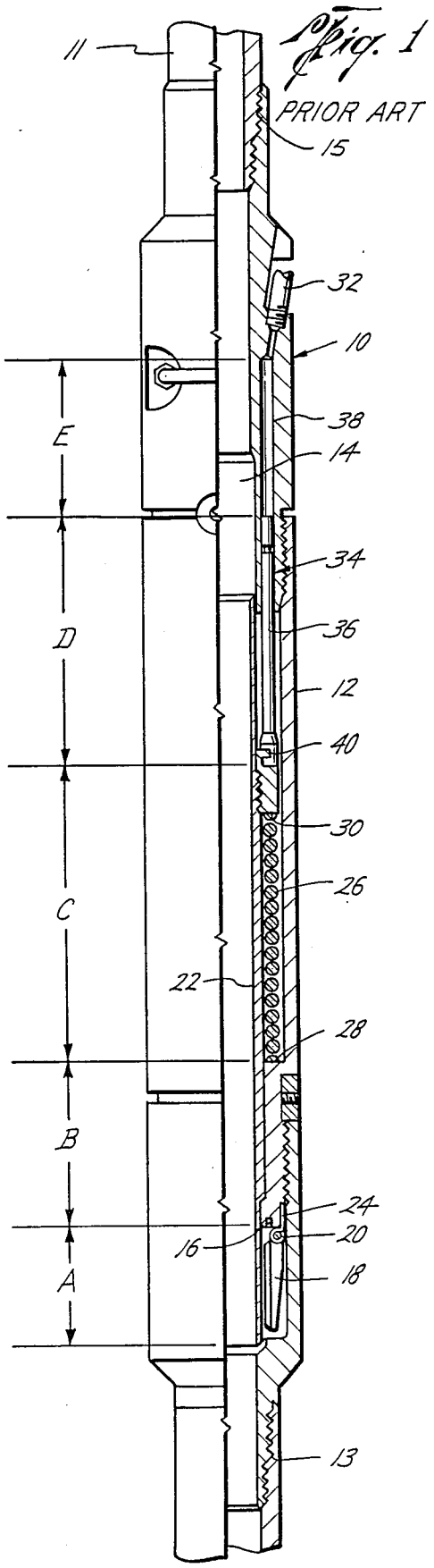
Fig. 1 PRIOR ART
FIG. 1 is an elevational view, in quarter section, of a prior art safety valve.

Referring now to the drawings, and particularly to FIG. 1, a prior art subsurface safety valve 10 is shown being of a tubing retrievable type for connection in a well conduit or well tubing 11 such as by threads 13 at one end and threads 15 at the other end. The valve 10 includes a body or housing 12 having a bore 14 through which well production flows under normal operating conditions, but which may be closed when desired.

A valve seat 16 is positioned in the bore 14 and a valve closure element, such as flapper valve 18, is connected to the housing 12 by a pivot pin 20. A longitudinal flow tube is telescopically movable in the housing 12 and through the valve seat 16. As seen in FIG. 1, when the flow tube 22 is moved to a downward position, the tube 22 pushes the flapper 18 away from the valve seat 16. The valve 10 is held in the open position so long as the flow tube 22 is in a downward position. When the flow tube 22 is moved upwardly, the flapper 18 is allowed to move upwardly onto the seat 16 by the action of a spring 24 and by the action of fluid flow moving upwardly through the bore 14. Biasing means such as a spring 26 or a pressurized chamber (not shown) acting between a shoulder 28 on the valve housing 12 and a shoulder 30 acts on the flow tube 22 for yieldably urging the flow tube 22 in a upward direction to release the flapper 18 for closing the valve 10.

The safety valve 10 is operated by the application or removal of a pressurized fluid, such as hydraulic fluid, through a control path or line, such as control line 32 extending to the well surface or the casing annulus (not shown). Hydraulic fluid is supplied to a piston and cylinder assembly 34 which includes a piston 36 movable relative to a cylinder member 38. One of the members, such as the piston 36, engages or is connected to the flow tube 22 by a tongue and groove connection 40. When pressure is applied to the control line 32 and to the piston and cylinder assembly 34, the flow tube 22 will be moved downwardly forcing the flapper 18 off of the seat 16 and into the open position. If the fluid pressure in the control line 32 is reduced sufficiently relative to the biasing forces urging the flow tube 22 upwardly, the flow tube 22 will be moved upwardly beyond the seat 16 allowing the valve element 18 to closed on the seat 16.

The above general description of a prior art subsurface safety valve is more fully described in U.S. Pat. No. 4,161,219.

However, the structure of the prior art valve 10 limits its overall length and consequently its size and cost. That is, the longitudinal length of the valve 10 includes longitudinal lengths A, B, C, D and E. The length A is the length of the stroke that the flow tube 22 must make between the closed position and the open position of the valve 10. Length B is the length of the seat support section. Length C is the length of the compressed biasing section. Length D is the length of the movable member of the hydraulic piston and cylinder assembly 34. Length E is the distance the hydraulic piston and cylinder assembly must retract between the open and closed stroke.

The prior art safety valve 10 for a 3½ inch safety valve made of stainless steel has an overall length of approximately 61 inches. Using Applicants' invention, a similar 3½ inch safety valve made of stainless steel would have an overall length of only 29 inches. The cost to manufacture the present invention is approximately 35% of the cost to manufacture the prior art valve.

Figure 2:
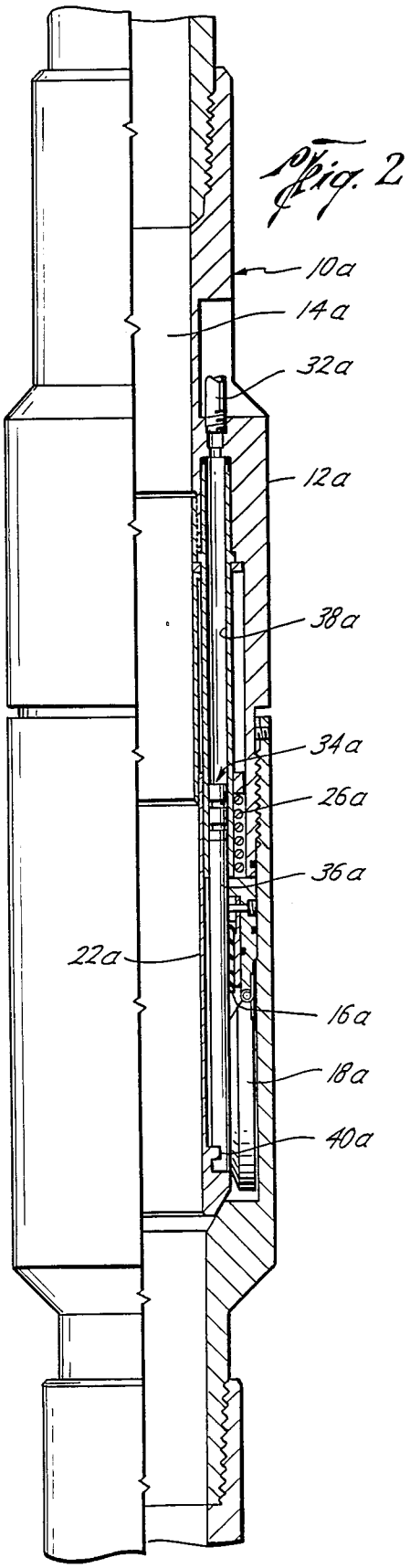
FIG. 2 is an elevational view, in quarter section, of one form of the safety valve of the present invention.
Figure 3:
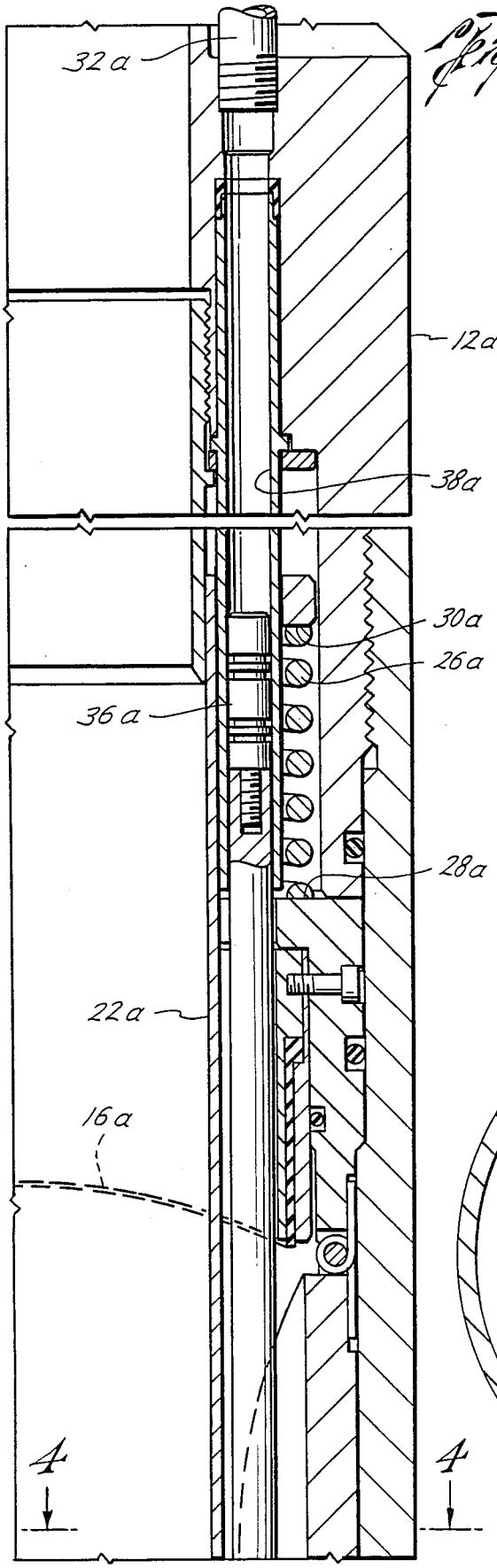
FIG. 3 is an enlarged fragmentary elevational view of the apparatus of FIG. 2.
Figure 4:
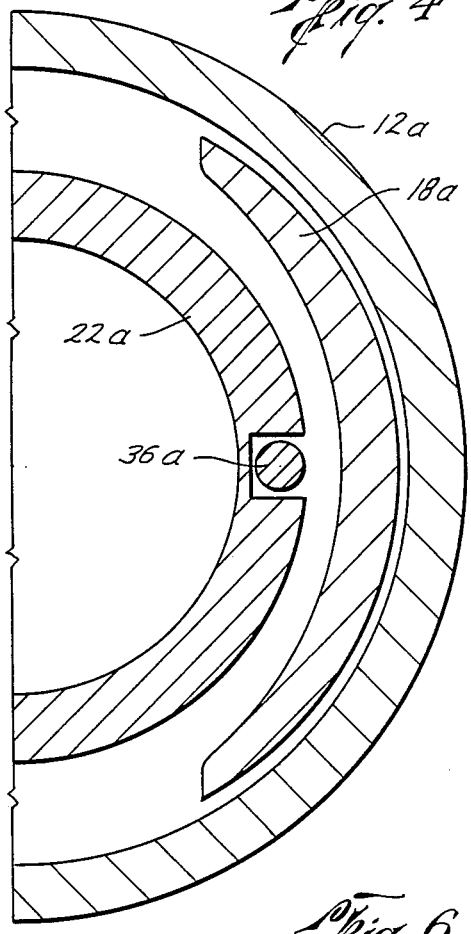
FIG. 4 is a cross-sectional view taken along the line 4—4 of FIG. 3.

Referring now to FIGS. 2, 3 and 4, one embodiment of the present invention is best seen in the form of a subsurface well safety valve wherein like parts to those shown in FIG. 1 are similarly numbered with the addition of the suffix "a".

Generally, the present invention shortens the overall length of the safety valve **10*a* by eliminating the dimension D of the prior art. That is, as best seen in FIGS. 2, 3 and 4, the moving member of the hydraulic piston and cylinder assembly 34*a*, here shown as the piston 36*a*, is positioned beside, that is, longitudinally overlapping the biasing means, here the spring 26*a*. Preferably, the movable member, such as piston 36*a*, is positioned inside of the biasing means, the spring 26*a*** for providing fewer moving parts and seals as compared to other embodiments.

It is to be noted that by placing the movable member **36*a* side by side and longitudinally overlapping the spring 26*a*, the member 36*a* moves past the valve seat 16*a* when the valve moves into the open position. In this embodiment, the flapper valve element 18*a* shares its space with the hydraulic piston and cylinder assembly 34*a*. Preferably, the piston 36*a* is positioned within the outer periphery of the flow tube 22*a*, as best seen in FIG. 4, which saves cross-sectional space and has the additional benefit in that there is a reduction in the "cocking" effect sometimes present in some valve designs. That is, the further the distance from the flow tube 22*a* the movable member 36*a* is located, the larger the torque that is transmitted to the flow tube 22*a*** tending to cock it.

While the flapper **18*a* and valve seat 16*a* may be flat, in the preferred embodiment, a curved or arcuate flapper valve 18*a* and seat 16*a* is preferred, as disclosed in U.S. Pat. No. 4,531,587, so that in the open position a larger bore 14 may be provided in the valve 10*a***.

Figure 6:
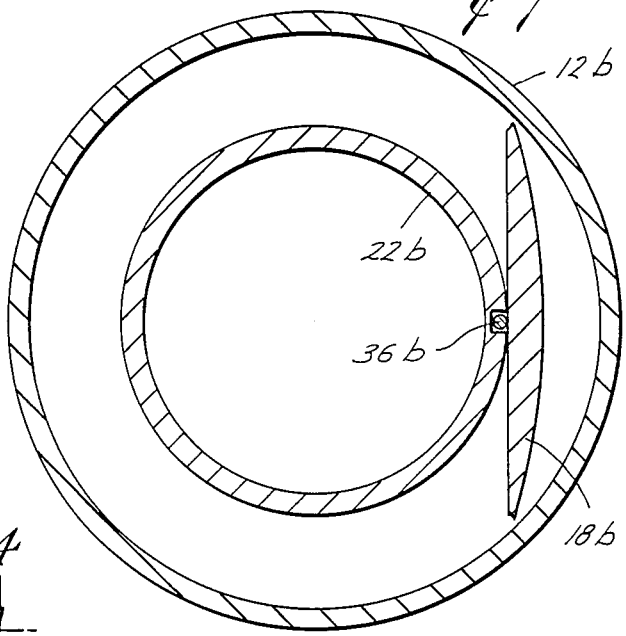
FIG. 6 is a cross-sectional view taken along the line 6—6 of FIG. 5.
Figure 5:
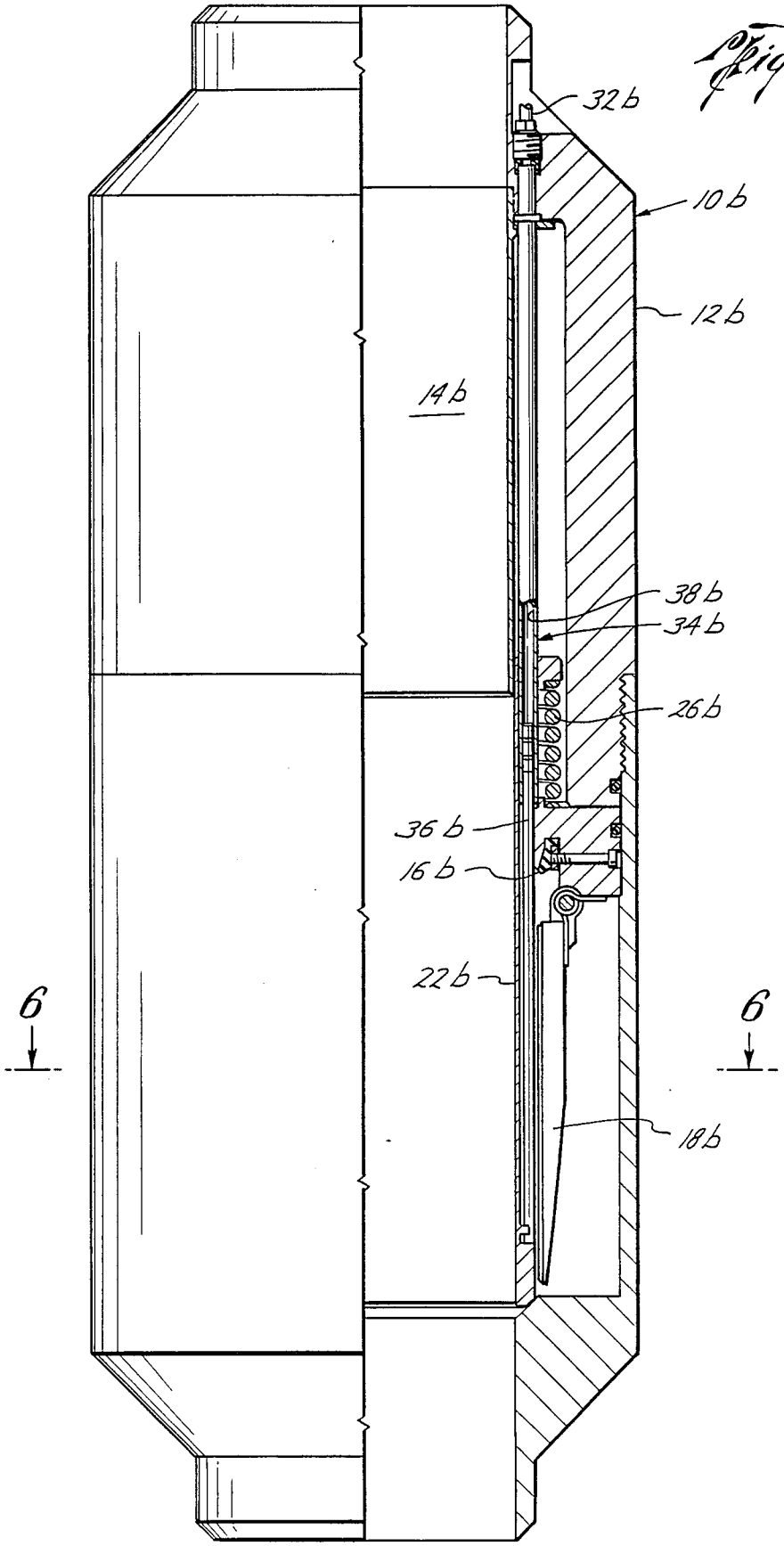
FIG. 5 is an elevational view, in quarter section, of a surface type safety valve according to the present invention.

Referring now to FIGS. 5 and 6, another embodiment of the present invention is shown in which the safety valve illustrated is a surface safety valve wherein like parts to those shown in FIGS. 1–4 are similarly numbered with the addition of the suffix "b". The valve **10*b* is similar in structure to the valve 10*a* except that the flapper 18*b* and valve seat 16*b* may be flat as the diameter of the valve 10*b*** becomes unimportant in surface applications.

Figure 7:
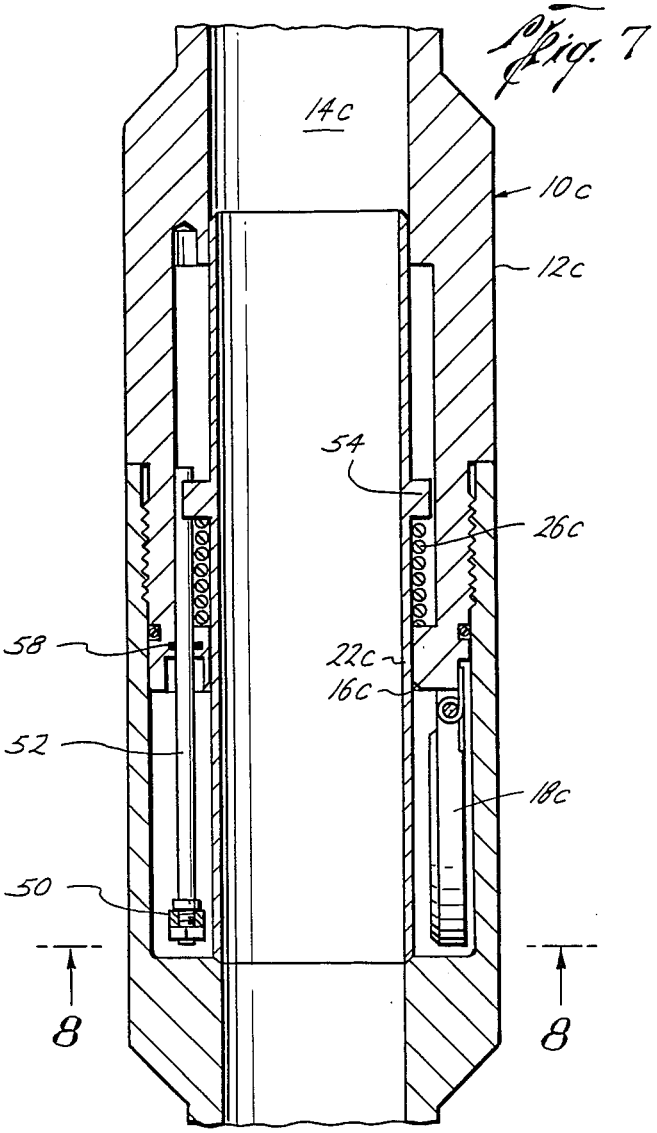
FIG. 7 is a fragmentary elevational view, in cross section, and shown schematically, of another embodiment of the present invention.
Figure 9:
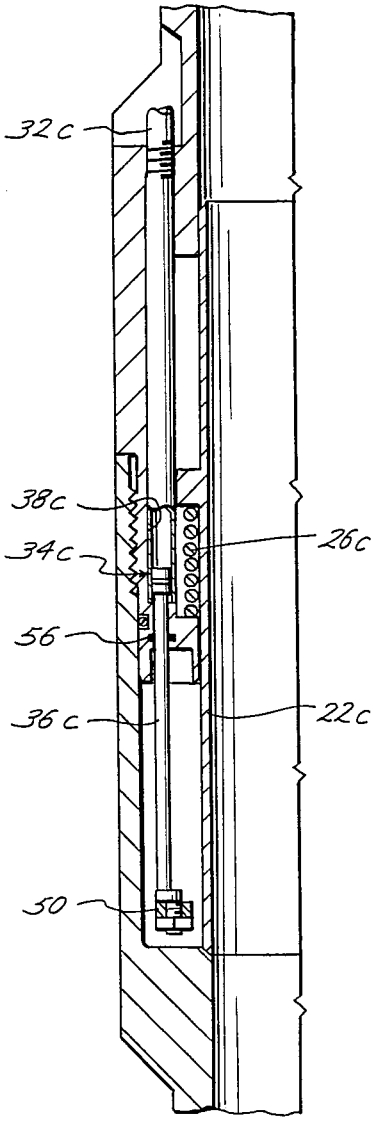
FIG. 9 is a cross-sectional view taken along the line 9—9 of FIG. 8.
Figure 8:
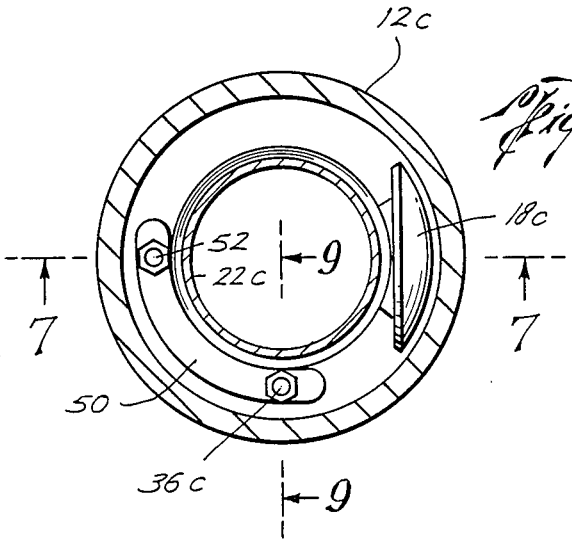
FIG. 8 is a cross-sectional view taken along the line 8—8 of FIG. 7.

Referring now to FIGS. 7, 8 and 9, a further embodiment of the present invention is best seen wherein like parts to those shown in FIGS. 1–6 are similarly numbered with the addition of the suffix "c". In this embodiment, the piston and cylinder assembly **34*c* is also beside and longitudinally overlaps the biasing means, such as the spring 26*c*, but the piston and cylinder assembly 34*c* is outside of the spring 26*c*. This arrangement is not as advantageous as the embodiment of FIGS. 2–4 as this geometry requires more moving parts and a greater number of seals than the first preferred embodiment. That is, the movable member of the piston and cylinder assembly 34, here piston 36*c*, is not connected directly to the flow tube 22*c*, but instead to an arcuate support 50 which in turn is connected to a rod 52 which is in turn connected to the flow tube 22*c* by the shoulder 54. However, this particular embodiment requires that seals 56 (FIG. 9) and seal 58 (FIG. 7), be provided around the movable member 36*c* and the rod 52**, respectively.

It is to be noted from FIGS. 2–9 that the housing of the present invention can be manufactured with only two sections, as compared with three sections of the prior art valve of FIG. 1. This feature further reduces manufacturing costs.

The present invention, therefore, is well adapted to carry out the objects and attain the ends and advantages mentioned, as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. A safety valve for controlling the fluid flow through a conduit comprising, a housing having a bore therethrough, a valve seat in the bore, a valve closure element moving between open and closed positions relative to the valve seat, a longitudinal flow tube telescopically movable in the housing for controlling the movement of the valve closure element, biasing means in the housing for biasing the flow tube in a direction for causing the valve closure element to move to the closed position, a piston and cylinder assembly positioned in the housing including a piston member movable relative to a cylinder member and one of said members engaging and moving the flow tube, and said one member being positioned overlapping said biasing means, thereby allowing the length of the valve to be reduced.

2. The valve of claim 1 wherein the one member is positioned inside of the biasing means

3. The valve of claim 1 wherein the one member is positioned outside of the biasing means.

4. The valve of claim 1 wherein the one member extends through the valve seat when the valve is in the open position.

5. The valve of claim 1 wherein the one member extends from one side of the valve seat to the second side of the valve seat when the valve moves to the open position.

6. The valve of claim 1 wherein the one member is positioned within the outer periphery of the flow tube.

7. The valve of claim 1 wherein the one member is positioned within the outer periphery of the flow tube and extends through the valve seat when the valve is in the open position.

8. A subsurface well safety valve for controlling the fluid flow through a well conduit comprising, a housing having a longitudinal bore therethrough, a valve seat in the bore, valve closure means moving between open and closed positions relative to the valve seat for controlling the fluid flow through the bore, a longitudinal flow tube telescopically moving in the housing coaxially with the bore for controlling the movement of the valve closure means, biasing means in the housing for biasing the flow tube in a direction for causing the valve closure means to move to the closed position, a piston and cylinder assembly positioned in the housing including a piston member movable relative to a cylinder member, and one of said members connected to and moving the flow tube, and said one member longitudinally overlapping and positioned on the inside of the biasing means.

9. The valve of claim 8 wherein the one member is longitudinally extended and overlaps the valve closure means when the valve moves to the open position.

10. The valve of claim 9 wherein the one member is positioned within the outer periphery of the flow tube.

11. The valve of claim 9 wherein the one member is connected to the flow tube at a position adjacent the lower end of the flow tube.

12. The valve of claim 9 wherein the housing includes only two sections,

* * * * *

UNITED STATES PATENT OFFICE

CERTIFICATE OF CORRECTION

Patent No. 4,860,991 Dated August 29, 1989

Inventor(s) William A. Blizzard et al.

It is certified that error appears in the above-identified patent and that said Letters Patent is hereby corrected as shown below:

Column 6, last line, delete the "," and insert -- . --

Signed and Sealed this

Twenty-fifth Day of September, 1990

*Attest:*

HARRY F. MANBECK, JR.

*Attesting Officer*

*Commissioner of Patents and Trademarks*